US009530597B2

(12) United States Patent
Hirai et al.

(10) Patent No.: US 9,530,597 B2
(45) Date of Patent: Dec. 27, 2016

(54) RELAY DRIVE DEVICE

(71) Applicant: Panasonic Intellectual Property Management Co., Ltd., Osaka (JP)

(72) Inventors: Takuya Hirai, Kanagawa (JP); Toshiki Ishii, Kanagawa (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 41 days.

(21) Appl. No.: 14/430,749

(22) PCT Filed: Sep. 20, 2013

(86) PCT No.: PCT/JP2013/005590
§ 371 (c)(1),
(2) Date: Mar. 24, 2015

(87) PCT Pub. No.: WO2014/050060
PCT Pub. Date: Apr. 3, 2014

(65) Prior Publication Data

US 2015/0279597 A1 Oct. 1, 2015

(30) Foreign Application Priority Data

Sep. 25, 2012 (JP) ..... 2012-210962

(51) Int. Cl.
*H01H 47/32* (2006.01)
*H01H 47/02* (2006.01)
(Continued)

(52) U.S. Cl.
CPC ..... *H01H 47/02* (2013.01); *H01H 47/002* (2013.01); *H01H 47/10* (2013.01); *H01H 47/22* (2013.01); *H01H 47/32* (2013.01)

(58) Field of Classification Search
USPC ..... 361/154, 196
See application file for complete search history.

(56) References Cited

U.S. PATENT DOCUMENTS 3,852,646 A * 12/1974 Mason ..... H03K 17/64 327/110
4,336,564 A * 6/1982 Wisniewski ..... E21B 47/18 361/154
(Continued)

FOREIGN PATENT DOCUMENTS

JP S54122354 U 8/1979
JP 54-129967 A 10/1979
(Continued)

OTHER PUBLICATIONS

Extended European Search Report for Application No. 13840652.5-1808/2903014 dated for Sep. 4, 2015.
(Continued)

*Primary Examiner* — Ronald W Leja
(74) *Attorney, Agent, or Firm* — Pearne & Gordon LLP

(57) ABSTRACT

A relay switch has a coil such that a predetermined voltage is imposed on one end thereof and the other end is grounded with a resistor therebetween, and when the voltage of the coil is at least a predetermined value, the relay switch is turned on and a power source is supplied to an electronic apparatus. A transistor causes the voltage of the coil to be at least the predetermined value by means of drawing in the current flowing through the coil and causing the current to flow to the ground without passing through the resistor when starting the supply of the power source, and after the start of supply of the power source, gradually decreases the amount drawn in of the current flowing through the coil, causing a decrease in a manner so that the voltage of the coil does not fall below the predetermined value.

4 Claims, 6 Drawing Sheets

(51) Int. Cl.

| | |
|---|---|
| ***H01H 47/10*** | (2006.01) |
| ***H01H 47/00*** | (2006.01) |
| ***H01H 47/22*** | (2006.01) |

(56) References Cited

U.S. PATENT DOCUMENTS

| | | | | |
|---|---|---|---|---|
| 5,018,366 | A * | 5/1991 | Tanaka | F04B 27/1804 327/482 |
| 5,235,490 | A * | 8/1993 | Frank | F02D 41/20 123/490 |
| 5,953,198 | A * | 9/1999 | Murata | H01H 47/002 361/152 |
| 6,493,204 | B1 * | 12/2002 | Glidden | B60T 8/36 361/154 |
| 6,798,634 | B2 * | 9/2004 | Hoepken | E05B 47/00 361/152 |
| 7,369,391 | B2 * | 5/2008 | Tanaka | H01H 47/04 361/154 |
| 8,212,389 | B2 * | 7/2012 | Morimoto | H01H 47/043 307/125 |
| 8,555,859 | B2 * | 10/2013 | Wirrer | F02D 41/20 123/478 |
| 2015/0279597 | A1 * | 10/2015 | Hirai | H01H 47/10 361/187 |

FOREIGN PATENT DOCUMENTS

| | | | |
|---|---|---|---|
| JP | S61151927 | A | 7/1986 |
| JP | 10-255627 | A | 9/1998 |
| JP | 2005-268134 | A | 9/2005 |

OTHER PUBLICATIONS

International Search Report for Application No. PCT/JP2013/005590 dated Dec. 10, 2013.

* cited by examiner

RELAY DRIVE DEVICE

TECHNICAL FIELD

The present invention relates to a relay drive apparatus that controls supply of electric power to an electronic device.

BACKGROUND ART

Relay drive apparatuses that drive a relay to supply electric power to an electronic device have been known heretofore (for example, Patent Literature (hereinafter, referred to as "PTL") 1. In the relay drive apparatus of PTL 1, a voltage of coil 6 of relay 8 is temporarily increased in a case where relay 8 is turned ON. The voltage of coil 6 is temporarily increased because an operation of relay 8 is likely to become unstable in a case where the relay drive apparatus is used in a high-temperature environment such as a vehicle-mounted charging apparatus, and relay 8 should be surely turned ON even in such cases. In the relay drive apparatus of PTL 1, an ON signal is output to first transistor 3 from first output terminal 2*a* of control circuit 2 so that first transistor 3 is put into a conduction state. In the relay drive apparatus of PTL 1, the voltage of coil 6 of relay 8 can be temporarily increased in this manner.

Meanwhile, the relay drive apparatus of PTL 1 lowers the voltage of coil 6 to reduce the power consumption after relay 8 is turned ON.

In other words, in the relay drive apparatus of PTL 1, first transistor 3 is maintained in an ON state from time t0 to time t1 as illustrated in FIG. 1. First transistor 3 is turned OFF after time t1 inclusive. In addition, in the relay drive apparatus of PTL 1, the voltage of coil 6 of relay 8 is high from time t0 to time t1 and is low after time t1 inclusive as illustrated in FIG. 2.

CITATION LIST

Patent Literature

PTL 1

Japanese Patent Application Laid-Open No. HEI 10-255627

SUMMARY OF INVENTION

Technical Problem

In PTL 1, however, the current flowing through coil 6 of relay 8 cannot be rapidly changed when first transistor 3 is switched from ON to OFF. As a result, in PTL 1, the current flowing through coil 6 flows to resistor 5 after first transistor 3 is turned OFF, and the voltage of coil 6 temporarily decreases. Relay 8 is turned OFF in a case where the temporarily decreased voltage becomes less than open voltage 51 of relay 8 as illustrated in FIG. 2.

An object of the present invention is to provide a relay drive apparatus capable of preventing a relay from being turned OFF when the voltage of a coil is lowered, by gradually reducing a drawing amount of a current that flows through the coil to reduce the voltage of the coil in a case where the current flowing through the coil of the relay is drawn to increase the voltage of the coil.

Solution to Problem

Advantageous Effects of Invention

A relay drive apparatus according to the present invention is a relay drive apparatus that controls supply of electric power to an electronic device, the relay drive apparatus including: a relay switch that includes a coil and that is turned ON when a voltage of the coil is equal to or greater than a predetermined value to supply the electric power to the electronic device, the coil having one end to which a predetermined voltage is applied and having another end grounded via a resistor; and a voltage adjusting section that increases the voltage of the coil to a value equal to or greater than the predetermined value by drawing a current which flows through the coil and allowing the current to flow to a ground not via the resistor when the supply of the electric power starts and that reduces the voltage of the coil to a voltage not below the predetermined value by gradually reducing a drawing amount of the current which flows through the coil after the supply of the electric power starts.

According to the present invention, it is possible to prevent a relay from being turned OFF when the voltage of a coil is lowered, by gradually reducing a drawing amount of a current that flows through the coil to thereby reduce the voltage of the coil in a case where the current flowing through the coil of the relay is drawn to increase the voltage of the coil.

DESCRIPTION OF EMBODIMENTS

Figure 1:
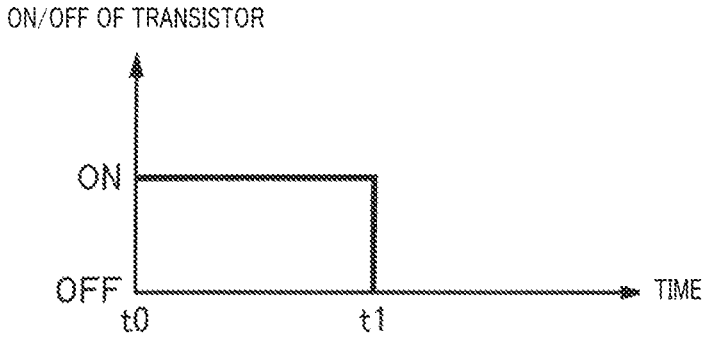
FIG. 1 is a diagram illustrating ON-OFF switching timing of a transistor of the related art.
Figure 2:
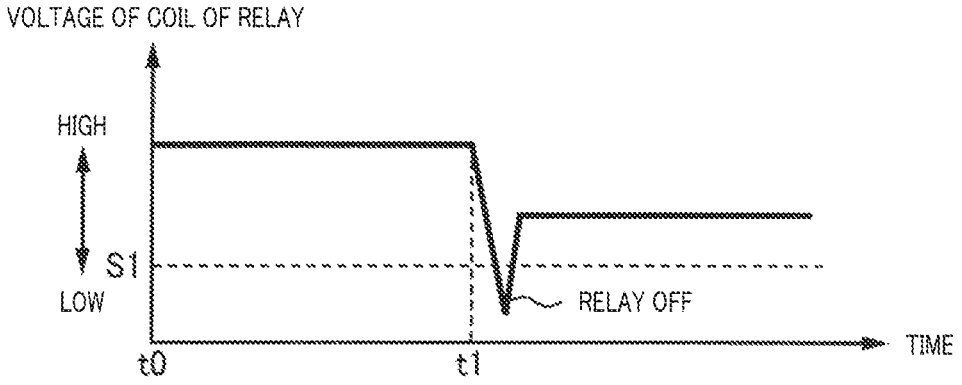
FIG. 2 is a diagram illustrating a time course of a voltage of a coil of a relay switch of the related art.

Hereinafter, embodiments of the present invention will be described in detail with reference to the accompanying drawings.

Embodiment 1

<Configuration of Relay Drive Apparatus>

A configuration of relay drive apparatus 100 according to Embodiment 1 of the present invention will be described with reference to FIG. 3. Relay drive apparatus 100 is disposed in a vehicle-mounted charging apparatus mounted on a vehicle that runs on electric power of a storage battery, examples of which include a hybrid electric vehicle (HEV), a plug-in electric vehicle (PEV), and an electric vehicle (EV).

Control section 101, transistor 102, relay switch 103, resistor 104, time constant circuit 105, and transistor 106 mainly constitute relay drive apparatus 100. Control section 101, time constant circuit 105, and transistor 106 constitute a voltage adjusting section.

Terminal 301 of control section 101 outputs a control signal for switching between conduction and non-conduction of transistor 102 to transistor 102. Terminal 301 of control section 101 outputs the control signal to time constant circuit 105 when supply of electric power to an electronic device (not illustrated) starts, and stops outputting the control signal after a predetermined time passes from the start of the output of the control signal. The predetermined time herein is, for example, one second from the start of the output of the control signal.

A base of transistor 102 is connected to terminal 301 of control section 101. An emitter of transistor 102 is connected to a power supply. A collector of transistor 102 is connected to one end of coil 201.

Relay switch 103 has coil 201 and switch 202. The one end of coil 201 is connected to the collector of transistor 102 and the other end of coil 201 is grounded via resistor 104. When transistor 102 conducts, a predetermined voltage is applied by the power supply to the one end (power supply side) of coil 201 via transistor 102. Coil 201 generates a magnetic force when a current flows. Switch 202 opens and closes connection between the power supply and the electronic device (not illustrated) and supplies electric power to the electronic device when turned ON. In a case where the voltage of coil 201 is equal to or greater than a predetermined value, switch 202 is turned ON by being affected by the magnetic force from coil 201. In addition, switch 202 is turned OFF when the magnetic force generated by the coil 201 goes away.

Resistor 104 is inserted in series between coil 201 and the ground. Resistor 104 is a resistor for adjusting the voltage of coil 201.

Resistor 401 and capacitor 402 are used to constitute time constant circuit 105. Time constant circuit 105 is disposed between terminal 302 of control section 101 and transistor 106. Time constant circuit 105 delays a control signal that is input from terminal 302 of control section 101 and outputs the control signal to a base of transistor 106. When the output of the control signal from terminal 302 of control section 101 stops, time constant circuit 105 causes a transient change in the control signal. Then, time constant circuit 105 outputs the control signal in which the transient change is caused to the base of transistor 106.

Transistor 106 adjusts the voltage of coil 201. The base of transistor 106 is connected to resistor 401. A collector of transistor 106 is connected to the other end (ground side) of coil 201. An emitter of transistor 106 is grounded. Transistor 106 conducts when a control signal is input to the base from time constant circuit 105, and performs a drawing operation by drawing the current that flows through coil 201 and allowing the current to flow to the ground not via resistor 104. After the output of the control signal from terminal 302 of control section 101 stops, the control signal in which the transient change is caused by time constant circuit 105 is input to the base of transistor 106, and transistor 106 gradually reduces the drawing amount of the current flowing through coil 201.

<Operation of Relay Drive Apparatus>

An operation of relay drive apparatus 100 according to Embodiment 1 of the present invention will be described with reference to FIGS. 3 to 5.

Figure 4:
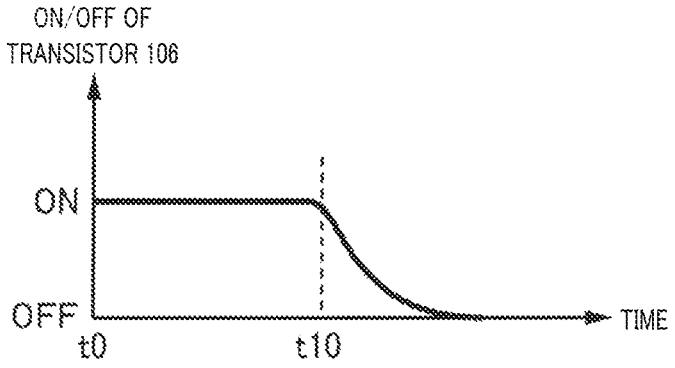
FIG. 4 is a diagram illustrating ON-OFF switching timing of a transistor according to Embodiment 1 of the present invention.
Figure 5:
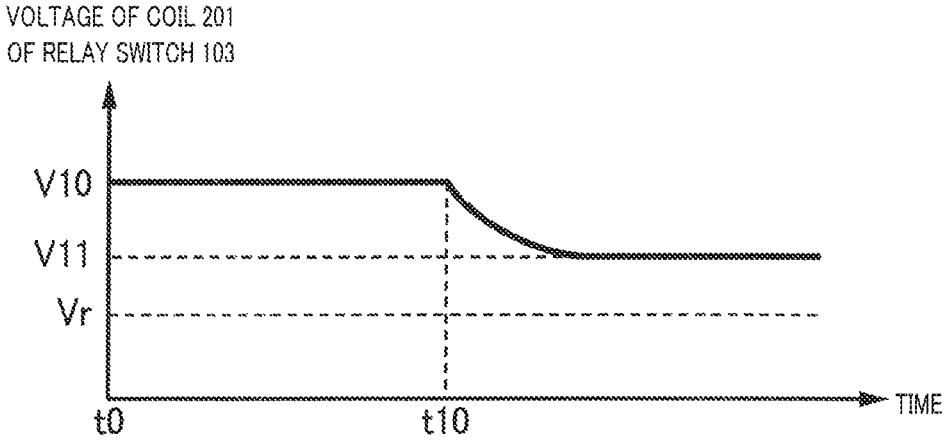
FIG. 5 is a diagram illustrating a time course of a voltage of a coil of a relay switch according to Embodiment 1 of the present invention.

First, control section 101 supplies a control signal from terminal 301 to the base of transistor 102 in order that transistor 102 conducts at time t0 as illustrated in FIG. 4. In addition, control section 101 supplies the control signal from terminal 302 to the base of transistor 106 in order that transistor 106 conducts.

Then, the current that is supplied from the power supply flows in the order of transistor 102, coil 201, transistor 106, and the ground. In other words, the current flowing through coil 201 is drawn to transistor 106 and flows to the ground via transistor 106. In this case, a potential difference between the one end and the other end of coil 201 increases, so that the voltage of coil 201 increases. For example, the voltage of coil 201 is v10 as illustrated in FIG. 5.

Then, control section 101 stops the output of the control signal from terminal 302 at time t10 that is when a predetermined time passes from time t0. In this case, time constant circuit 105 causes a transient change in the control signal and outputs the control signal in which the transient change is caused to the base of transistor 106. As a result, switching of transistor 106 from ON to OFF can be moderated as illustrated in FIG. 4, and the drawing amount of the current flowing through coil 201 can be gradually reduced. In other words, the current that flows in the order of the power supply, transistor 102, coil 201, transistor 106, and the ground gradually goes away.

As described above, the current flowing through coil 201 flows to the ground via transistor 106 for a while after time t10, and thus a rapid decrease in the voltage of coil 201 can be prevented. Accordingly, the voltage of coil 201 does not fall below relay open voltage Vr after time t10 inclusive as illustrated in FIG. 5. As a result, relay switch 103 is not turned OFF after time t10 inclusive.

The current flowing through coil 201 flows to the ground via resistor 104 in a case where transistor 106 does not conduct. Accordingly, the voltage of coil 201 is maintained at voltage V11.

<Effects of Embodiment 1>

In this embodiment, relay switch 103 can be prevented from being turned OFF when the voltage of coil 201 is lowered, by gradually reducing the drawing amount of the current flowing through coil 201 to reduce the voltage of coil 201 in a case where the current flowing through coil 201 of relay switch 103 is drawn to increase the voltage of coil 201.

In addition, according to this embodiment, the voltage of coil 201 is increased when the supply of the electric power starts. Accordingly, an ON operation of relay switch 103 can be surely performed even in a case where relay drive apparatus 100 is disposed in a high-temperature environment such as a vehicle-mounted charging apparatus.

In addition, according to this embodiment, the voltage of coil 201 is reduced after a predetermined time passes from the start of the supply of the electric power, which enables power saving.

Embodiment 2

<Configuration of Relay Drive Apparatus>

A configuration of relay drive apparatus 600 according to Embodiment 2 of the present invention will be described with reference to FIG. 6. Relay drive apparatus 600 is disposed in a vehicle-mounted charging apparatus mounted on a vehicle that runs on electric power of a storage battery, examples of which include an HEV, a PEV, and an EV.

Figure 3:
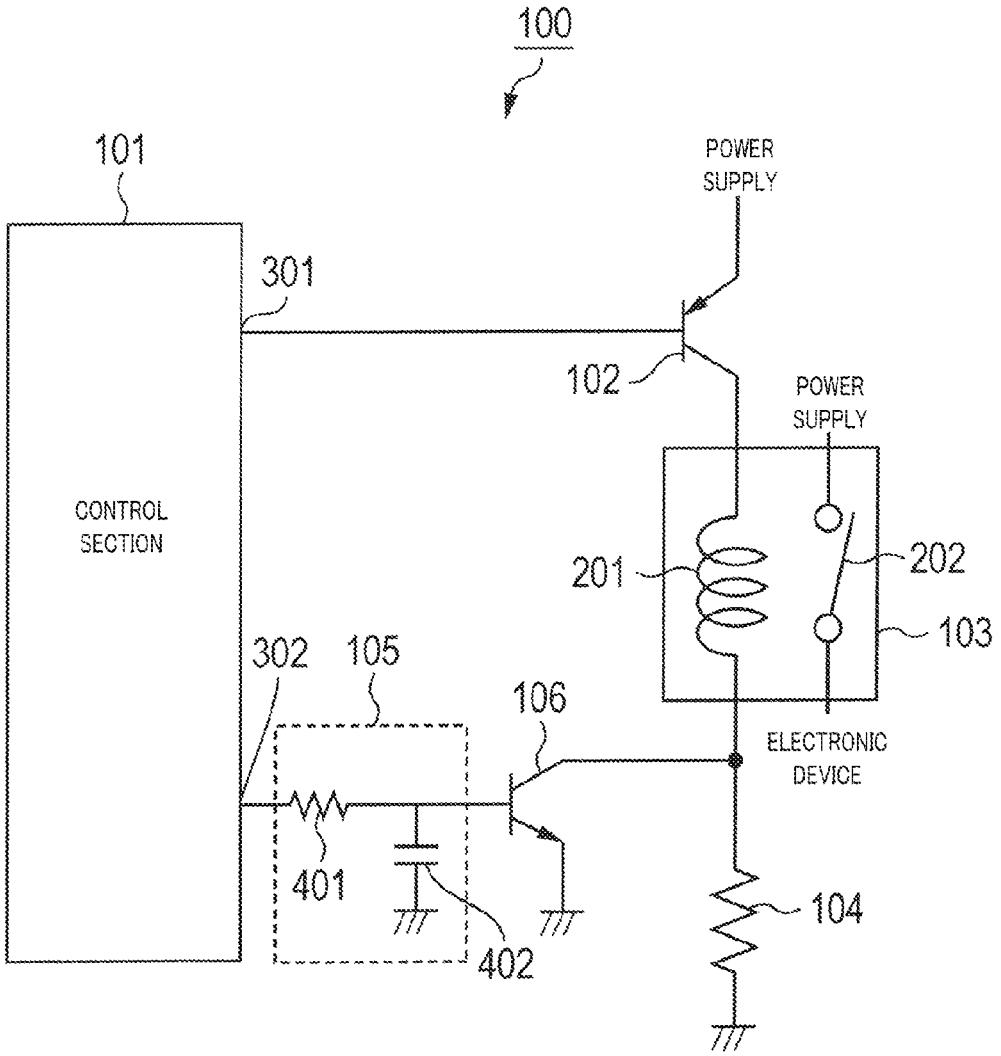
FIG. 3 is a diagram illustrating a configuration of a relay drive apparatus according to Embodiment 1 of the present invention.
Figure 6:
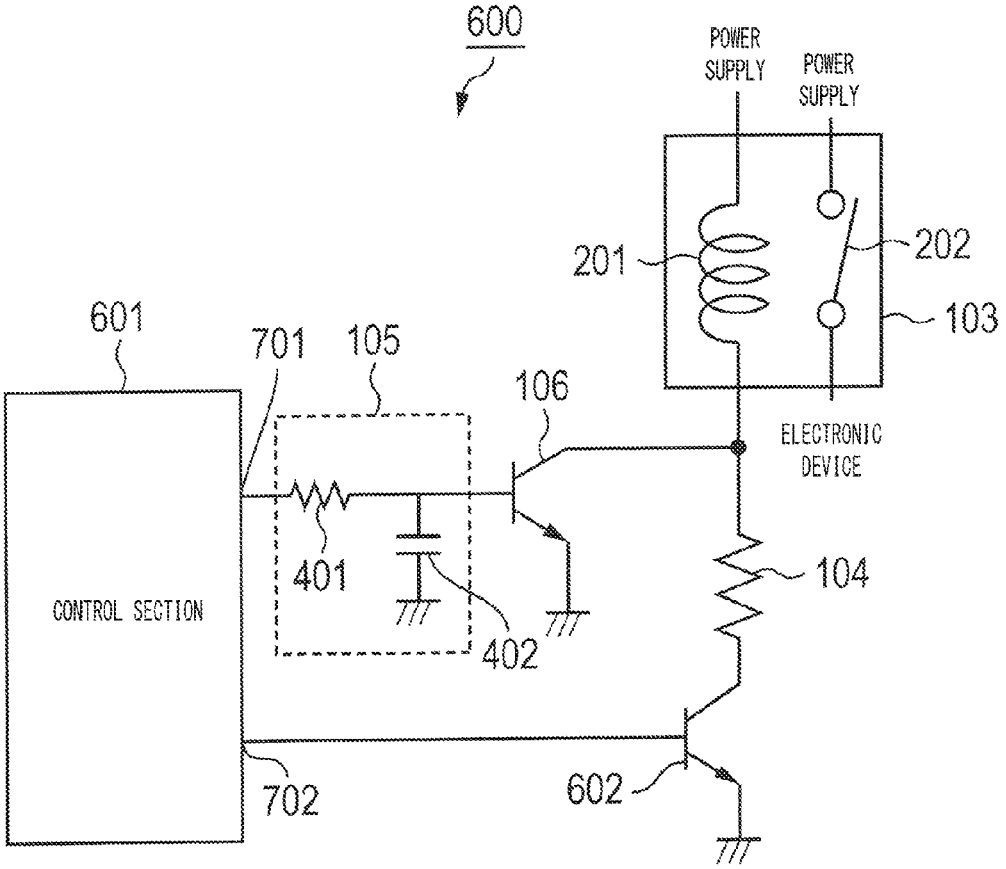
FIG. 6 is a diagram illustrating a configuration of a relay drive apparatus according to Embodiment 2 of the present invention.

Compared to relay drive apparatus 100 according to Embodiment 1 illustrated in FIG. 3, relay drive apparatus 600 illustrated in FIG. 6 includes no transistor 102, but includes transistor 602 and also includes control section 601 instead of control section 101. In FIG. 6, the same reference numerals as in FIG. 3 are used to refer to the same parts and description thereof will be omitted.

Relay switch 103, resistor 104, time constant circuit 105, transistor 106, control section 601, and transistor 602 mainly constitute relay drive apparatus 600. Time constant circuit 105, transistor 106, and control section 601 constitute a voltage adjusting section.

Terminal 701 of control section 601 outputs a control signal to time constant circuit 105 when electric power is supplied to the electronic device (not illustrated). Terminal 702 of control section 601 outputs a control signal for switching between conduction and non-conduction of transistor 602 to transistor 602.

One end of coil 201 of relay switch 103 is connected to the power supply and the other end of coil 201 of relay switch 103 is grounded via resistor 104 and transistor 602. A predetermined voltage is applied to the one end of coil 201 by the power supply. The configuration of relay switch 103 other than what is described above is identical to that in Embodiment 1 described above. Thus, description thereof will be omitted.

Resistor 104 is inserted in series between coil 201 and transistor 602.

A base of transistor 602 is connected to terminal 702 of control section 601. A collector of transistor 602 is connected to resistor 104. An emitter of transistor 602 is grounded.

Time constant circuit 105 is disposed between terminal 701 of control section 601 and transistor 106. Time constant circuit 105 delays the control signal that is input from terminal 701 of control section 601 and outputs the control signal to the base of transistor 106. After the output of the control signal from terminal 701 of control section 601 stops, time constant circuit 105 causes a transient change in the control signal. The configuration of time constant circuit 105 other than what is described above is identical to that in Embodiment 1 described above. Thus, description thereof will be omitted.

<Operation of Relay Drive Apparatus>

An operation of relay drive apparatus 600 according to Embodiment 2 of the present invention will be described with reference to FIGS. 4 to 6. ON-OFF switching timing of transistor 106 is identical to that in FIG. 4 and a time course of change in the voltage of coil 201 is identical to that in FIG. 5. Thus, the operation of relay drive apparatus 600 will be described with reference to FIGS. 4 and 5 as well as FIG. 6.

First, control section 601 supplies the control signal from terminal 702 to the base of transistor 602 in order that transistor 602 conducts at time t0 as illustrated in FIG. 4. In addition, control section 601 supplies the control signal from terminal 701 to the base of transistor 106 in order that transistor 106 conducts.

Then, the current that is supplied from the power supply flows in the order of coil 201, transistor 106, and the ground. In other words, the current flowing through coil 201 is drawn to transistor 106 and flows to the ground via transistor 106. In this case, the potential difference between the one end and the other end of coil 201 increases, so that the voltage of coil 201 increases. For example, the voltage of coil 201 is v10 as illustrated in FIG. 5.

Then, control section 601 stops the output of the control signal from terminal 701 at time t10 that is when a predetermined time passes from time t0. In this case, time constant circuit 105 causes the transient change in the control signal and outputs the control signal in which the transient change is caused to the base of transistor 106. As a result, switching of transistor 106 from ON to OFF can be moderated as illustrated in FIG. 4, and the drawing amount of the current flowing through coil 201 can be gradually reduced. In other words, the current that flows in the order of the power supply, coil 201, transistor 106, and the ground also goes away gradually.

As described above, the current flowing through coil 201 flows to the ground via transistor 106 for a while after time t10, and thus a rapid decrease in the voltage of coil 201 can be prevented. Accordingly, the voltage of coil 201 does not fall below relay open voltage Vr after time t10 inclusive as illustrated in FIG. 5. As a result, relay switch 103 is not turned OFF after time t10 inclusive.

The current flowing through coil 201 flows to the ground via resistor 104 and transistor 602 in a case where transistor 106 does not conduct. Accordingly, the voltage of coil 201 is maintained at voltage V11.

<Effects of Embodiment 2>

In this embodiment, relay switch 103 can be prevented from being turned OFF when the voltage of coil 201 is lowered, by gradually reducing the drawing amount of the current flowing through coil 201 to lower the voltage of coil 201 in a case where the current flowing through coil 201 of relay switch 103 is drawn to increase the voltage of coil 201.

In addition, according to this embodiment, the voltage of coil 201 is increased when the supply of the electric power starts. Accordingly, an ON operation of relay switch 103 can be surely performed even in a case where relay drive apparatus 600 is disposed in a high-temperature environment such as a vehicle-mounted charging apparatus.

In addition, according to this embodiment, the voltage of coil 201 is reduced after a predetermined time passes from the start of supply of the electric power, which enables power saving.

Embodiment 3

<Configuration of Relay Drive Apparatus>

A configuration of relay drive apparatus 800 according to Embodiment 3 of the present invention will be described with reference to FIG. 7. Relay drive apparatus 800 is disposed in a vehicle-mounted charging apparatus mounted on a vehicle that runs on electric power of a storage battery, examples of which include an HEV, a PEV, and an EV.

Figure 7:
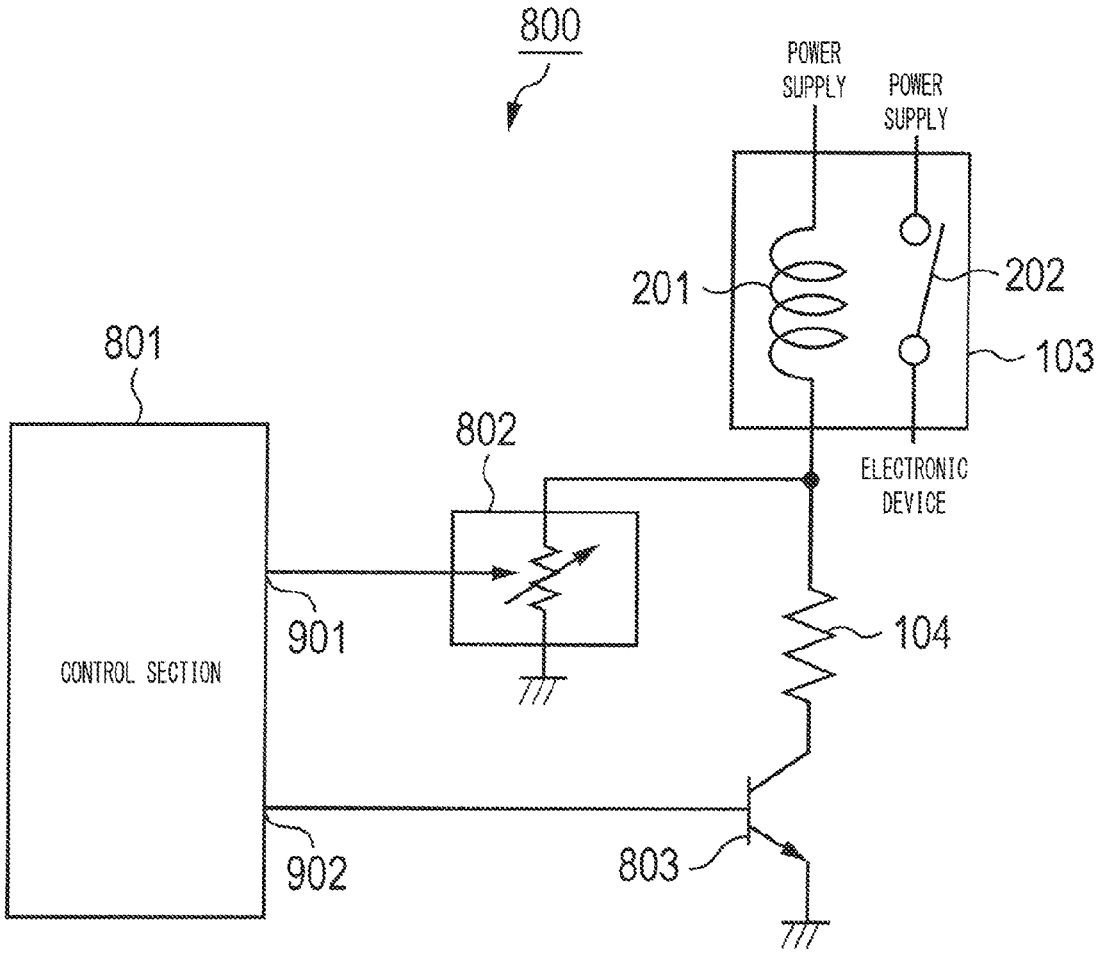
FIG. 7 is a diagram illustrating a configuration of a relay drive apparatus according to Embodiment 3 of the present invention.

Compared to relay drive apparatus 100 according to Embodiment 1 illustrated in FIG. 3, relay drive apparatus 800 illustrated in FIG. 7 includes no transistor 102, time constant circuit 105, and transistor 106, but includes variable resistor 802 and transistor 803 and also includes control section 801 instead of control section 101. In FIG. 7, the same reference numerals as in FIG. 3 are used to refer to the same parts and description thereof will be omitted.

Relay switch 103, resistor 104, control section 801, variable resistor 802, and transistor 803 mainly constitute relay drive apparatus 800. Control section 801 and variable resistor 802 constitute a voltage adjusting section.

Terminal 901 of control section 801 changes a resistor value of variable resistor 802 by outputting a control signal to variable resistor 802 when and after supply of electric power to the electronic device (not illustrated) starts. Terminal 902 of control section 801 outputs a control signal for switching between conduction and non-conduction of transistor 803 to a base of transistor 803.

One end of coil 201 of relay switch 103 is connected to the power supply and the other end of coil 201 of relay switch 103 is grounded via resistor 104 and transistor 803. A predetermined voltage is applied to the one end of coil 201 by the power supply. The configuration of relay switch 103 other than what is described above is identical to that in Embodiment 1 described above. Thus, description thereof will be omitted.

Resistor 104 is inserted in series between coil 201 and transistor 803.

One end of variable resistor 802 is connected to the other end of coil 201 and the other end of variable resistor 802 is grounded. When the supply of electric power to the electronic device starts, variable resistor 802 performs a drawing operation including changing the resistance value in accordance with control made by the control signal that is input from control section 801, drawing the current flowing through coil 201, and allowing the current to flow to the ground not via resistor 104. After the supply of the electric power to the electronic device starts, variable resistor 802 changes the resistance value in accordance with the control made by the control signal that is input from control section 801, and gradually reduces the drawing amount of the current flowing through coil 201.

A base of transistor 803 is connected to terminal 902 of control section 801. A collector of transistor 803 is connected to resistor 104. An emitter of transistor 803 is grounded.

<Operation of Relay Drive Apparatus>

An operation of relay drive apparatus 800 according to Embodiment 3 of the present invention will be described with reference to FIGS. 7 to 9.

Figure 8:
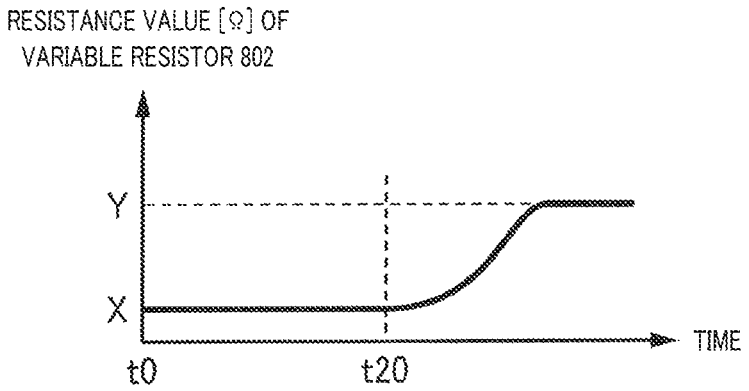
FIG. 8 is a diagram illustrating a time course of change in a resistance value of a variable resistor according to Embodiment 3 of the present invention.
Figure 9:
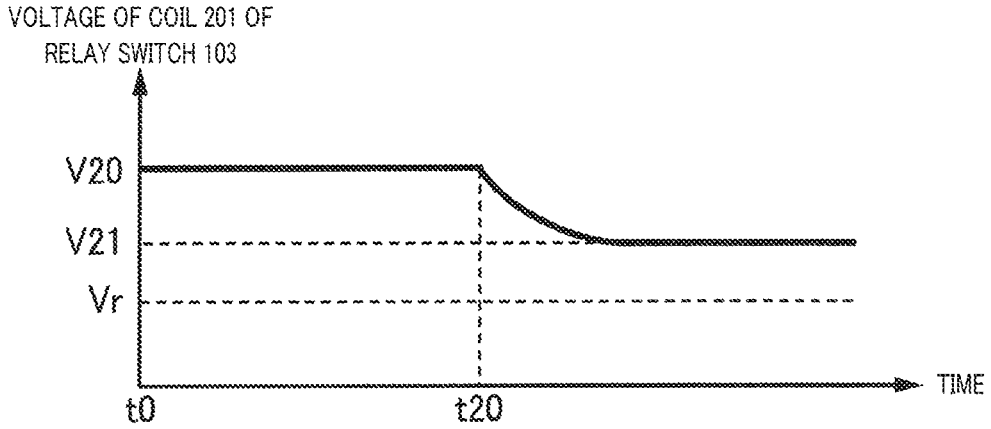
FIG. 9 is a diagram illustrating a time course of a voltage of a coil of a relay switch according to Embodiment 3 of the present invention.

First, control section 801 supplies a control signal from terminal 902 to the base of transistor 803 in order that transistor 803 conducts at time t0 as illustrated in FIG. 8. In addition, control section 801 supplies the control signal from terminal 901 to variable resistor 802 in order that the resistance value of variable resistor 802 is reduced to XΩ. Resistance value X is much smaller than the resistance value of resistor 104 (resistance value X<<resistance value of resistor 104).

Then, the current that is supplied from the power supply flows in the order of coil 201, variable resistor 802, and the ground. In other words, the current flowing through coil 201 is drawn to variable resistor 802 and flows to the ground via variable resistance 802. In this case, the potential difference between the one end and the other end of coil 201 increases, so that the voltage of coil 201 increases. For example, the voltage of coil 201 is V20 as illustrated in FIG. 9.

Then, control section 801 supplies the control signal from terminal 901 to variable resistor 802 at time t20 that is when a predetermined time passes from time t0, and gradually increases the resistance value of variable resistor 802 from XΩ to Y(X<Y)Ω as illustrated in FIG. 8. As a result, the drawing amount of the current flowing through coil 201 can be gradually reduced by variable resistor 802. In other words, the current that flows in the order of the power supply, coil 201, variable resistor 802, and the ground gradually goes away. Resistance value Y is much larger than the resistance value of resistor 104 (resistance value Y>>resistance value of resistor 104).

As described above, the current flowing through coil 201 flows to the ground via variable resistor 802 for a while after time t20, and thus a rapid decrease in the voltage of coil 201 can be prevented. Accordingly, the voltage of coil 201 does not fall below relay open voltage Vr after time t20 inclusive as illustrated in FIG. 9. As a result, relay switch 103 is not turned OFF after time t20 inclusive.

In a case where the resistance value of variable resistor 802 reaches YΩ, the current flowing through coil 201 flows to the ground via resistor 104 and transistor 803. Thus, the voltage of coil 201 is maintained at voltage V21.

<Effects of Embodiment 3>

In this embodiment, the current flowing through coil 201 of relay switch 103 is drawn by using variable resistor 802. Accordingly, not only can the effect of Embodiment 1 described above be achieved but the configuration can also be simplified.

<Variation Common to Each Embodiment>

In Embodiments 1 to 3 described above, the drawing amount is gradually reduced after a predetermined time passes from the start of supply of the electric power to the electronic device. However, the drawing amount may be gradually reduced in a case where a temperature that is detected by a temperature sensor becomes equal to or lower than a predetermined temperature. In this case, the relay switch can be surely turned ON in a high-temperature environment when the relay drive apparatus is used in a high-temperature environment, and power-saving can be enabled in a relatively low temperature environment.

In Embodiments 1 to 3 described above, the relay drive apparatus is disposed in a vehicle-mounted charger, but can also be disposed in any apparatus other than the vehicle-mounted charger.

The disclosure of Japanese Patent Application No. 2012-210962, filed on Sep. 25, 2012, including the specification, drawings and abstract, is incorporated herein by reference in its entirety.

INDUSTRIAL APPLICABILITY

The relay drive apparatus according to the present invention is suitable for controlling supply of electric power to an electronic device.

REFERENCE SIGNS LIST

100 Relay drive apparatus
101 Control section
102, 106 Transistor
103 Relay switch
104, 401 Resistor
105 Time constant circuit
201 Coil
202 Switch
301, 302 Terminal
402 Capacitor

The invention claimed is:

1. A relay drive apparatus that controls supply of electric power to an electronic device, the relay drive apparatus comprising:

a relay switch that includes a coil and that is turned ON when a voltage of the coil is equal to or greater than a predetermined value to supply the electric power to the electronic device, the coil having one end to which a predetermined voltage is applied and having another end grounded via a resistor; and a voltage adjusting section that increases the voltage of the coil to a value equal to or greater than the predetermined value by drawing a current which flows through the coil and allowing the current to flow to a ground not via the resistor when the supply of the electric power starts and that reduces the voltage of the coil to a voltage not below the predetermined value by gradually reducing a drawing amount of the current which flows through the coil after the supply of the electric power starts, wherein the voltage adjusting section includes:

a control section that outputs a control signal when the supply of the electric power starts, and that stops outputting the control signal after a predetermined time passes from the start of the output of the control signal;

a time constant circuit that causes a transient change in the control signal when the control section stops outputting the control signal; and a transistor that conducts when receiving the control signal and draws the current flowing through the coil and gradually reduces the drawing amount by receiving the control signal in which the transient change is caused by the time constant circuit after the outputting of the control signal stops.

2. A vehicle-mounted charging apparatus comprising the relay drive apparatus according to claim 1.

3. The relay drive apparatus according to claim 1, further comprising a transistor whose base is connected to a second terminal of the control section, the second terminal being different from a first terminal to which the control signal is outputted, to whose emitter the predetermined voltage is applied, and whose collector is connected to one end of the coil.

4. The relay drive apparatus according to claim 1, further comprising a transistor whose base is connected to a second terminal of the control section, the second terminal being different from a first terminal to which the control signal is outputted, whose collector is connected to the resistor, and whose emitter is connected to the ground.

* * * * *